United States Patent [19]

Furukawa

[11] Patent Number: 4,480,425

[45] Date of Patent: Nov. 6, 1984

[54] VACUUM PACKAGING APPARATUS

[75] Inventor: Takao Furukawa, Onomichi, Japan

[73] Assignee: Kabushiki Kaisha Furukawa Seisakusho, Tokyo, Japan

[21] Appl. No.: 338,448

[22] Filed: Jan. 8, 1982

[30] Foreign Application Priority Data

Jan. 16, 1981 [JP] Japan ..... 56-5770

[51] Int. Cl.[3] ..... B65B 11/52

[52] U.S. Cl. ..... 53/509; 53/511; 53/202

[58] Field of Search ..... 53/168, 103, 202, 86, 53/390, 427, 509, 511

[56] References Cited

U.S. PATENT DOCUMENTS

| | | | |
|---|---|---|---|
| 3,129,545 | 4/1964 | Sloan | 53/511 |
| 3,785,116 | 1/1974 | Munz | 53/140 X |
| 3,835,618 | 9/1974 | Perdue | 53/509 |
| 4,269,016 | 5/1981 | Kopp | 53/202 X |
| 4,363,203 | 12/1982 | Marshall | 53/168 |

*Primary Examiner*—John Sipos

*Attorney, Agent, or Firm*—Ladas & Parry

[57] ABSTRACT

A vacuum packaging apparatus has two lower chambers with open upper face in side-by-side arrangement in a base box and a single upper chamber with an open bottom face in an upper head which is supported by a plurality of links on the base box and can be shifted alternately from atop one lower chamber to atop the other thereby to form alternatively two vacuum chambers for vacuum packaging. Moving parts of the apparatus are actuated by an electric and vacuum control system including some valves, some switches for controlling the valves, fluid passages formed in the base box and the upper and lower heads and a vacuum pump. While vacuum packaging is being carried out in the vacuum chamber formed on one side, preparation of a commodity to be packaged and packaging materials can be carried out in the other lower chamber.

6 Claims, 5 Drawing Figures

VACUUM PACKAGING APPARATUS

BACKGROUND OF THE INVENTION

This invention relates to a vacuum packaging apparatus for packaging articles or commodities such as beef, fish and the like by sandwiching them between two pieces of packaging material.

Vacuum packaging apparatuses of this kind are disclosed in U.S. Pat. No. 3,835,618, U.S. Pat. No. 3,129,545 and Australian Pat. No. 245,774. In each of these vacuum packaging apparatuses, the commodity is placed, in a vacuum chamber, on a piece of a lower packaging material such as thermoplastic film or reclaimed paper with plastic membrane on its surface and then is covered with a piece of an upper packaging material heated at a temperature approaching its melting point so that the upper packaging material can adhere to the lower packaging material with the commodity sandwiched therebetween.

The vacuum packaging apparatus of the U.S. Pat. No. 3,835,618 has a relatively large vacuum chamber in which large pieces of packaging material corresponding to the planar area of the chamber are used. Accordingly, this apparatus has an advantage in that a large number of articles of various shapes such as pieces of beef and fish can be easily packaged at one time in any desired disposition in the vacuum chamber. On the other hand, however, a relatively long period is required for obtaining again a desired degree of vacuum in the chamber when it is closed after the chamber has been once opened to take the articles after packaging out of the chamber. Thus, a time loss is incurred. The wasted period can be shortened by using a vacuum pump of large capacity. However, if such a vacuum pump were used, the pressure in the vacuum chamber of the apparatus would change excessively to cause the packaging material to be ruptured, and the heating time for the packaging material would be shortened to cause shortening of the heating time of the packaging material.

Furthermore, since the capacity of the pump to be used is limited for reasons of economy, a pump of a reasonable capacity should be selected, in which case, a period of at least about five seconds will be unavoidably required for obtaining a vacuum. In this case, there is a five-second wasted period during which the operator is idle, whereby an efficiency loss is incurred.

The vacuum packaging apparatus of Australian Pat. No. 245,774 also has only one vacuum chamber, and the operator must close and open the chamber manually to put the articles to be packaged into the chamber and take them out of the chamber. In this apparatus, also, the operator must wait without doing anything for the vacuum packaging to be completed.

In the apparatus of U.S. Pat. No. 3,129,545, as a plurality of vacuum chambers are mounted on a chain conveyor, such a wasted period is short. However, it not only needs a complex structure for driving the chain conveyor but also is bulky.

Accordingly, in a known attempt to solve this problem, a pair of vacuum packaging apparatuses are disposed in side-by-side arrangement, and the preparation for packaging is carried out in one of the apparatuses while the vacuum packaging is being carried out in the other. In this method, wasted idle period is eliminated, but it requires two apparatuses and is, therefore, uneconomical. More specifically, this method needs two vacuum pumps, either one of which does not operate during vacuum packaging operation, and two valve control systems for controlling valves in each apparatus.

SUMMARY OF THE INVENTION

It is an object of this invention to provide a simplified vacuum packaging apparatus having an operation substantially corresponding to those of two conventional apparatuses wherein there is provided a base box with two lower chambers in side-by-side arrangement, the base box supporting an upper head having an upper chamber by means of a plurality of parallel links, the upper head in operation being alternately place on the each of the lower chambers to form alternately a vacuum packaging chamber for carrying out vacuum packaging operation.

Another object of this invention is to provide a vacuum packaging apparatus having fewer control valves to simplify its organization and to reduce its manufacturing cost.

A further object of this invention is to provide a vacuum packaging apparatus having an upper head which is easily and efficiently operable by an operator without fatigue, whereby the efficiency of vacuum packaging operation can be increased.

According to this invention there is provided a vacuum packaging apparatus comprising: a base box having first and second recessed lower chambers with open tops in side-by-side arrangement with a specific space therebetween; an upper head having a recessed upper chamber with an open bottom adapted to be transferable alternately from atop one lower chamber to atop the other thereby to bring the upper chamber into airtight register alternately with the lower chambers to form alternately two vacuum chambers; a vertical movable table disposed in each of the lower chambers and adapted to support thereon packaging material and articles to be packaged; a vacuum-operated cylinder for vertically moving each of the tables; a vacuum control system for controlling the air pressures in the vacuum chambers and the vacuum-operated cylinders in accordance with the progress of the vacuum packaging operation.

The nature, utility, and further features of this invention will be more clearly apparent from the following detailed description with respect to a preferred embodiment of the invention when read in conjunction with the accompanying drawings.

Figure 1:
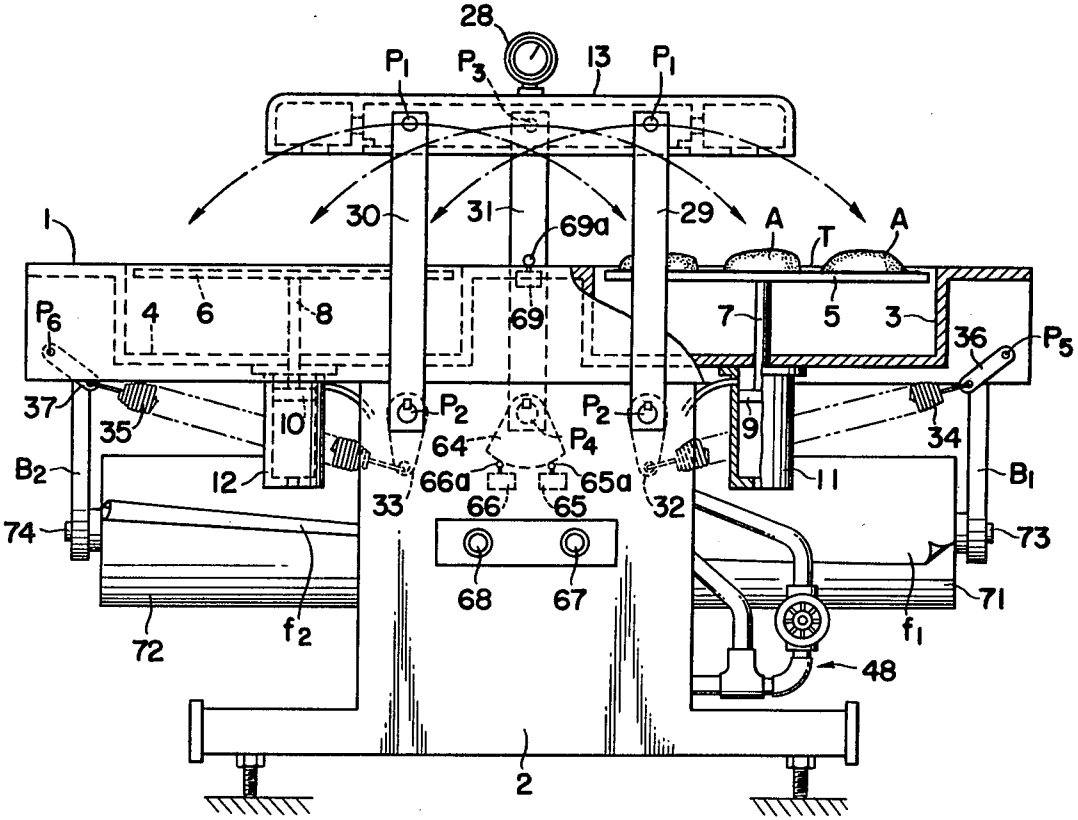
FIG. 1 is a front elevational view, with parts cut away and some parts in vertical section, showing a vacuum packaging apparatus according to this invention with an upper head being in a raised state.
Figure 2:
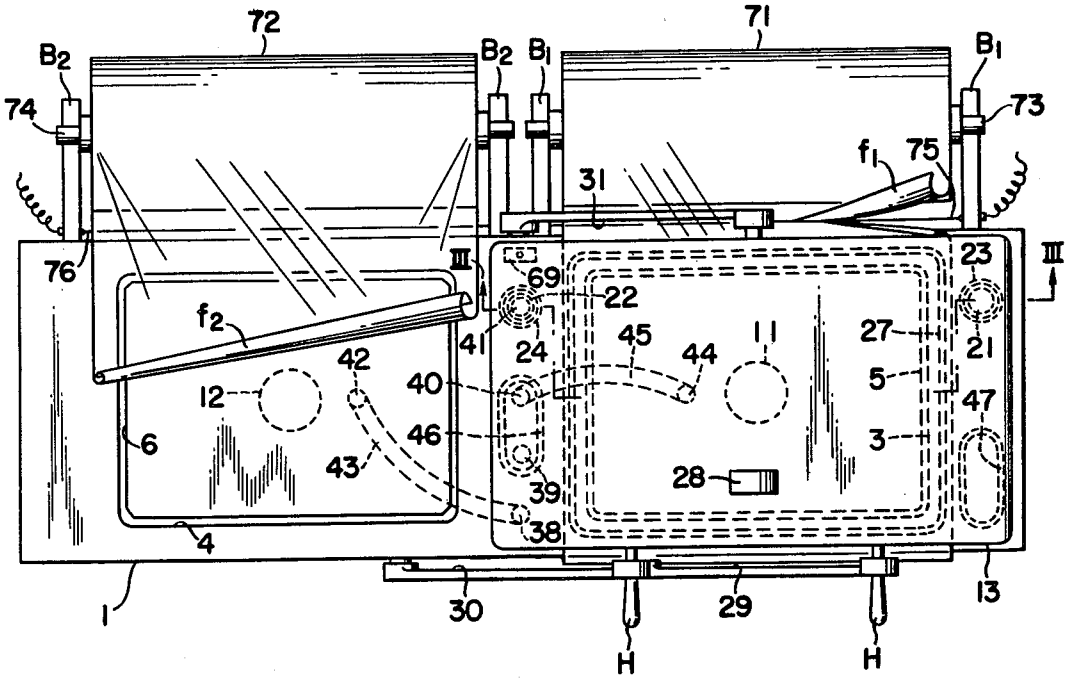
FIG. 2 is a plan view showing essential parts of the vacuum packaging apparatus.
Figure 3:
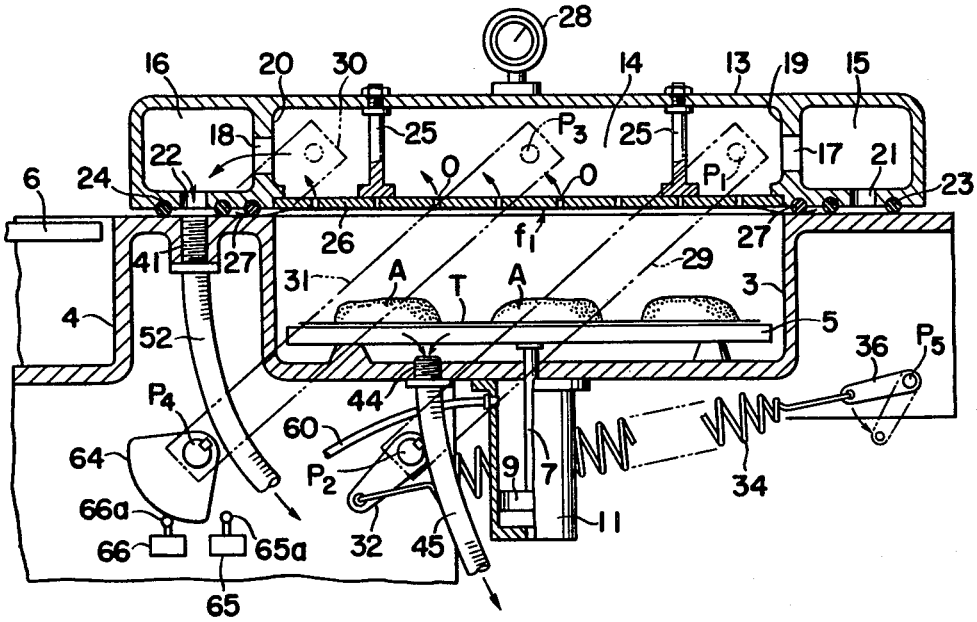
FIG. 3 is an enlarged front elevational view in vertical section taken along the plane indicated by line III—III in FIG. 2 as viewed in the arrow direction.

Throughout this disclosure, directions referred to as "left" and "right" are the left and right directions as viewed in FIGS. 1 through 3, and those referred to as "front" and "rear" are directions toward the lower and upper parts, respectively in FIG. 2.

DETAILED DESCRIPTION OF THE INVENTION

Referring first to FIGS. 1 and 2, a vacuum packaging apparatus, according to this invention, has a base box 1 extending in the left-right direction and supported on a supporting frame 2 fixed to a floor. The base box 1 is provided at its right and left sides with downwardly recessed first and second chambers 3 and 4 of identical dimensions. These two chambers 3 and 4 are each in the shape of a rectangular parallelepiped and are open at the upper face of the box 1. These chambers 3 and 4 have relatively large volumes respectively and are formed in left and right, side-by-side positions in lateral alignment. These pit-like chambers 3 and 4, which will hereinafter be called lower chambers, respectively accommodate vertically movable tables 5 and 6 fixedly supported at their central parts on the upper ends of vertical piston rods 7 and 8, respectively. The piston rods 7 and 8 extend downwardly, in air-tight state, through the bottoms of the lower chambers 3 and 4 and are fixed at their lower ends to respective pistons 9 and 10 disposed within and cooperatively operable with respective air cylinders 11 and 12 mounted on the lower face of the base box 1. Thus, the tables 5 and 6 are raised and lowered by the cylinders 11 and 12 when their pistons 9 and 10 are moved by pressure difference as described more fully hereinafter.

Above the base box 1, there is provided a single upper head 13 having an upwardly recessed chamber 14 and respective auxiliary chambers 15 and 16 on the right and left sides of the chamber 14 as clearly shown in FIG. 3. The two auxiliary chambers 15 and 16 are communicatively connected to the chambers 14 through two connecting holes 17 and 18 formed in two dividing walls 19 and 20 for separating the auxiliary chambers 15 and 16 from the upper chamber 14, respectively.

Through the bottom walls of the auxiliary chambers 15 and 16 are provided two upper fluid passages 21 and 22, respectively, at the same positions in the front-rear direction, and partly in the lower faces of the bottom walls of the chambers 15 and 16 and around the passages 21 and 22 are provided two annular sealing material 23 and 24 for air-tightness between the lower face of the upper head 13 and the upper face of the base box 1 when the upper head 13 is placed on either side of the base box 1.

The upper chamber 14 is closed at its bottom part with a heating plate 26, which is fixedly supported by a plurality of supporting bars 25, 25 suspended from the upper ceiling wall of the upper head 13. The heating plate 26 has a heating mechanism, not shown in the drawings, to heat a sheet of thermoplastic film, placed over each of the lower chambers 3 and 4, as packaging material for some articles A on the each of the tables 5 and 6. The heating plate 26 has also a plurality of small communication openings O formed at proper intervals to communicatively connect the upper chamber 14 with each of the lower chambers 3 and 4 during the packaging operation.

An endless closed-figure sealing material 27 is provided at the lower face and around the lower opening of the upper chamber 14 thereby to preserve airtightness between the lower surface of the upper chamber 14 and the upper surface of the base box 1. When either lower chamber 3 or 4 is covered by the upper head 13, it is in register with the upper chamber 14 and the auxiliary chambers 15 and 16 are respectively placed on outer sides of either lower chamber 3 or 4. On the upper ceiling wall of the upper head 13 is mounted a vacuum meter 28 for measuring and indicating the degree of vacuum in the chambers 3, 4 and 14.

The upper head 13 is pivotably supported at its front side by two pins $P_1$ and $P_1$ to the upper ends of parallel supporting links 29 and 30, which are pivotably joined at their lower ends, by two pins $P_2$ and $P_2$, to the front face of the frame 2. The rear side of the upper head is pivotably supported, by a pin $P_3$, on the upper end of an auxiliary supporting link 31, which is pivotably joined at its lower end by a pin 4 to the rear face of the frame 2. Furthermore, at the upper ends of the parallel supporting links 29 and 30 are respectively provided two handles H and H which the operator holds with his hands when the upper head 13 is moved from one side of the base box 1 to the other. To the lower ends of the parallel supporting links 29 and 30 are respectively fixed two lever arms 32, 33 constituting extensions of these links 29 and 30 beyond their pivot pins $P_2$, $P_2$. The outer ends of these arms 32, 33 are connected respectively to the inner ends of two tension coil springs 34 and 35. The outer ends of these coil springs 34 and 35 are connected to inner lower ends of two turning links 36 and 37, the outer upper ends of which are pivotably connected by two pins $P_5$ and $P_6$ to the right and left ends of the base box 1.

When the upper head 13 is in a neutral raised position as shown in FIG. 1, no load is exerted on the two coil springs 34 and 35, which are being suspended at their outer ends by the turning links 36 and 37. At this time, the axes of the coil springs 34 and 35 intersect the longitudinal axes of the turning links 36 and 37, respectively.

When the upper head 13 is moved toward either chamber 3 or 4, one of the coil springs 34 and 35 corresponding to the chamber 3 or 4 to be closed by the upper head 13 is stretched with its turning link 36 or 37 turning inward, whereby it becomes aligned with its coil spring. At the same time, the other coil spring is moved outwardly or in the outer direction of the base box 1 to cause its turning link to turn outward. That is, the spring force of each coil spring does not act on its turning link until the axis of that link becomes aligned with the axis of that coil spring. Accordingly, there is a neutral angular region within which the links 29 and 30 can freely turn to the left and right sides. It is desirable to set this neutral region at about 30 degrees of angle. In this case, the two links 29 and 30 are permitted to incline freely in the range of 15 degrees to either the left or right side from the vertical position as shown in FIG. 1.

In the neutral region, the links 29 and 30 are unstable. Actually, however, they remain in the vertical position because the same weight of each of the two coil springs 34 and 35 is exerted on each of the lower ends of the links 29 and 30, respectively.

Figure 4:
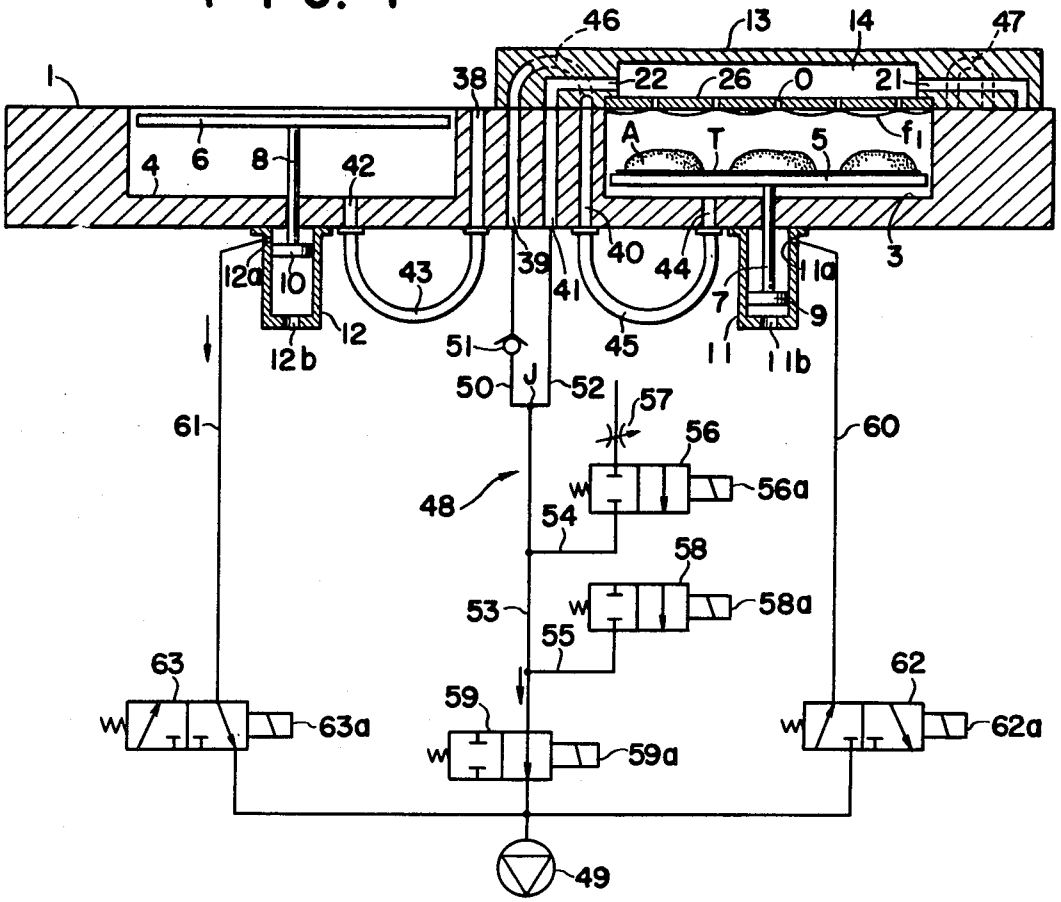
FIG. 4 is a schematic view showing a fluid circuit diagram of a vacuum control system with a vertical sectional view of the apparatus in the state of vacuum packaging operation in the right-hand chamber thereof.

The base box 1 is provided along a front-to-rear line midway between the two lower chambers 3 and 4 with a row of four vertical fluid passages as shown in FIGS. 2 and 4. The four fluid passages comprise first, second, third and fourth passages 38, 39, 40 and 41 in that order from the front side of the base box 1. In FIG. 4, the four passages are shown as being disposed parallely in the left-right direction for the sake of clarity of description of the fluid flow of a fluid control system. The first fluid passage 38 is communicatively connected to a fifth fluid passage 42 formed through the bottom of the second lower chamber 4 via a fluid pipe 43. On the other hand, the third fluid passage 40 is connected to a sixth fluid passage 44 formed through the bottom of the first lower chamber 3 via a fluid pipe 45.

As shown in FIG. 2, the upper head 13 is provided with an endless packing material 46 of elongated chain-link shape disposed at a position, on the left lower surface of the upper head 13, where it can enclose together the second and third fluid passages 39 and 40 thereby to establish communication therebetween when the upper head 13 is placed over the first lower chamber 3. Furthermore, the upper head 13 is provided with a packing material 47 of the same shape as the packing 46 disposed at a position, on the right lower surface thereof, where it can enclose together the first and second fluid passages 38 and 39 thereby to establish communication therebetween, when the upper head 13 is placed over the second lower chamber 4. That is, with respect to the front face of the base box 1, the packing 46 on the left side of the upper head is placed at a farther position than the packing 47 on the right side of the upper head 13.

The fourth passage 41 alternately registers with each of the upper fluid passages 21 and 22 of the upper head 13 when each of the lower chambers 3 and 4 is alternately closed by the upper head 13. All of the packings 23, 24, 46 and 47 described above are firmly bonded to the lower surface of the upper head 13 by an adhesive. Those packings, however, may be fixedly inserted in partly imbedded state into shallow grooves formed in the surface of the upper head, respectively. In this case, it is necessary that at least half of the circular cross section of the packings must project toward the upper surface of the base box 1 from the lower surface of the upper head 13.

The second and fourth fluid passages 39 and 41 are communicatively connected, via a chamber vacuum control line 48 for evacuating the lower and upper chambers to a vacuum pump 49. The control line 48 comprises a first air line 50 having a check valve 51 and connected to the first fluid passage 39, a second air line 52 connected to the fourth fluid passage 41 and joined together to the first air line 50 at a junction J, a main air line 53 extending between the junction J and the vacuum pump 49, and two branch air lines 54 and 55 branching out of the main air line 53. In the branch air line 54, an electromagnetically operated shut-off valve 56 of 2-port, 2 position type, operated by a solenoid **56*a* is provided for introduction of atmospheric air via a throttle valve 57. In the branch air line 55, a shut-off solenoid valve 58 actuated by a solenoid 58*a* similar to the valve 56 is provided. Furthermore, at an intermediate part of the main air line 53 between the branch line 55 and the vacuum pump 49 is installed a direction-control valve 59 of 2-position, 2 port type for controlling air flow in the main air line 53**.

In addition to the chamber vacuum control line 48, two cylinder control pipe lines 60 and 61 for adjusting air pressure in the air cylinders 11 and 12, respectively, are connected to the vacuum pump 49. In the pipe lines 60 and 61, there are provided two direction-control valves 62 and 63 of 2-position, 3 port-type, driven by solenoids **62*a* and 63*a* for controlling air flow in the pipe lines 60 and 61**, respectively.

The ends of the lines 60 and 61 remote from the vacuum pump 49 are joined to air ports **11*a* and 12*a* formed in the upper portions of the side walls of the cylinders 11 and 12, respectively. In the bottoms of the cylinders 11 and 12 are formed two air openings 11*b* and 12*b* for connecting the lower sides of the pistons 9 and 10 in the cylinders 11 and 12** to the atmosphere, respectively.

To the lower end of the auxiliary supporting link 31 on the rear side of the base box 1 is fixed a fan-shaped cam 64 which operates two limit switches 65 and 66 having two actuators **65*a* and 66*a* respectively and disposed at appropriate intervals in the left-right direction as shown in FIG. 1. When the upper head 13 is in the neutral position as shown in FIG. 1, both of the actuators 65*a* and 66*a* contact the surface of the cam 64. However, when the upper head is moved to either the left or right side, one of them, disposed on the side toward which the upper head is moved separates from the cam 64, while the other remains in contact with the cam surface as shown in FIG. 3**.

Furthermore, on the front face of the supporting frame 2 are installed two push buttons 67 and 68, and near the fourth passage 41, in the ceiling wall of the base box 1 is mounted a limit switch 69, having an actuator **69*a* projecting upward beyond the upper surface of the base box 1 and operated by the lower surface of the upper head 13**. These switches and push buttons mentioned hereinabove operate the valves in the air fluid control system, whose operation is described hereinafter.

The base box 1 has, on its rear side, two pairs of brackets $B_1$,$B_1$ and $B_2$,$B_2$, for rotatably supporting two rotating shafts 73 and 74 for supporting in turn two rolls 71 and 72 of thermoplastic films $f_1$ and $f_2$. These brackets extend obliquely and downwardly from the rear side of the base box 1. Nichrome electric resistance wires 75 and 76 respectively for cutting the films $f_1$ and $f_2$ in their transverse direction by heating them above their melting point are stretched, along the rear side of the box 1, between the two pairs of brackets $B_1$,$B_1$ and $B_2$,$B_2$.

The vacuum packaging apparatus of the above described construction and organization according to this invention is operated in the following manner.

Figure 5:
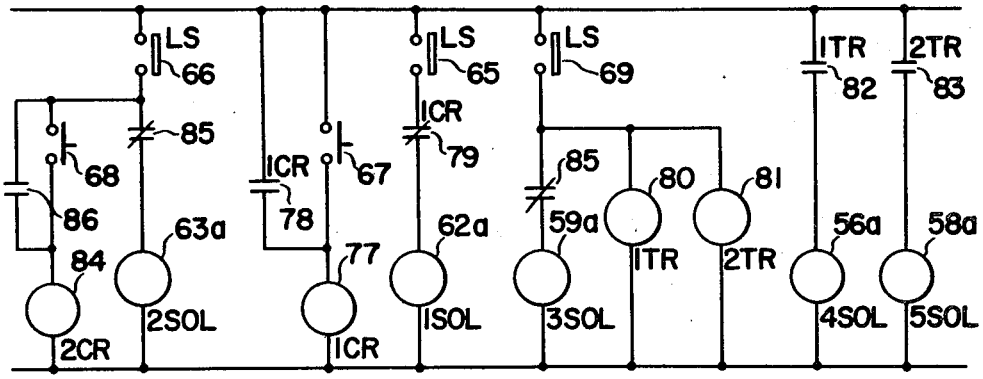
FIG. 5 is an electrical circuit diagram showing the electrical circuit of the vacuum control system according to this invention.

The upper head 13 is adapted to operate cooperatively with either of the lower chambers 3 and 4 of the base box 1 and their respective tables 5 and 6. When the upper head 13 is in the neutral raised state, the normally open limit switches 65 and 66 are being closed with their respective actuators **65*a* and 66*a* contacting the cam surface 64. As described hereinbefore there is a free moving zone of 30 degrees within which the parallel links 29 and 30 can move freely clockwise and counterclockwise by 15 degrees from their vertical positions, and so long as the upper head 13 is within this zone, the limit switches 65 and 66 are being closed by the cam surface to energize the solenoids 62*a* and 63*a* of the direction-control valves 62 and 63 respectively, whereby the valves 62 and 63 are changed to their closed positions opposite to those as shown in FIG. 5**.

Thus, the upper sides of the pistons 9 and 10 of the air cylinders 11 and 12 are made communicative with the vacuum pump 49 through the lines 60 and 61, respectively, whereupon the pistons 9 and 10 are forced upward to raise the tables 5 and 6, respectively. Accordingly, when the upper head 13 is in the neutral state, the tables 5 and 6 are at their upper positions in the lower chambers 3 and 4.

With the apparatus in the above described state, the operator lays a sheet of table paper T or lower packaging material on the table 5 and then places some articles A to be packaged on the table paper T. Subsequently, he pushes the push button 67 on the right side to energize a relay 77, whereby a self-hold switch 78 is closed to open a normally closed switch 79 positioned between the limit switch 65 and the solenoid 62*a*. Therefore, the solenoid 62*a* of the direction-control valve 62 is deenergized to change over the valve 62 to its opened position as shown in FIG. 4 whereby atmospheric air is introduced into the upper side of the piston 9 of the cylinder 11 by way of the line 60 thereby to lower the table 5 holding the articles A thereon to its lower position.

The operator then draws the film $f_1$ on the right side out of the roll 71 and forward over the upper opening of the lower chamber 3, and when the film $f_1$ thus drawn out and forward is placed on the base box 1, the rear side of the film $f_1$ touches the heated Nichrome wire 75, thereby being cut away from the roll 71 as shown in FIG. 2. The upper head 13 is then moved onto the lower chamber 3 to close it with the film $f_1$ placed over the chamber 3 and being pushed against the surface of the base box 1 by the lower surface of the upper head.

When the operator moves the upper head 13 by holding the handles H and H of the parallel links 29 and 30 with his hands, he can rotate the links 29 and 30 clockwise by pushing them lightly within the range of 15 degrees from their vertical position without the coil spring 34 being stretched. After these links pass beyond this range, the upper head 13 moves over and toward the chamber 3, the coil spring 34 then being stretched. When, during this operation, the operator pushes the upper head 13 lightly clockwise from its highest neutral position, the inertia of its movement contributes to the rotation of the links 29 and 30 beyond the neutral zone or the free moving zone, the coil spring 34 thereby being stretched. Therefore, the operator can operate the upper head easily and he does not become tired with this kind of repeating work for a long time, whereby a high efficiency for the vacuum packaging operation is obtained.

When the upper head 13 is placed over and against the lower chamber 3, the limit switch 69 mounted in the center of the left-right direction of the base box 1 is operated by the actuator 69*a*, being pushed by the lower surface of the upper head 13, thereby to energize the solenoid 59*a* of the shut-off valve 59 in the main line 53. As a consequence, the valve 59 is changed over to its opened position as shown in FIG. 4. At the same time, first and second timers 80 and 81 connected parallelly to each other and the solenoid 59*a* as shown in FIG. 5 are operated.

When the valve 59 is changed over to its opened position, the fourth passage 41 registers with the upper fluid passage 22, and the second fluid passage 39 is made communicative with the third passage 40 by the enlarged packing material 46. Accordingly, the upper chamber 14 is connected to the vacuum pump 49 by way of the upper fluid passage 22, the fourth fluid passage 41, the second air line 52, the main air line 58, and the valve 59, and the lower chamber 3 is connected to the vacuum pump 49 by way of the sixth fluid passage 44, the fluid pipe 45, the third fluid passage 40, the second fluid passage 39, the first air line 50 with the check valve 51, the main air line 53, and the valve 59. Furthermore, as the fluid passage 21 on the right side of the upper head 13 at this time is tightly closed with the packing material 23 touching the upper surface of the base box 1, the upper and lower chambers 14 and 3 are evacuated by the vacuum-pump 49, whereby the air pressures of the two chambers 3 and 14 begin to decrease.

At the beginning of the evacuation, the degree of the vacuum in the upper chamber 14 is greater than that of the vacuum in the lower chamber 3 because the volume of the upper chamber 14 is smaller than that of the lower chamber 3, and the lower chamber is evacuated via the check valve 51. Accordingly, at this time, the film $f_1$ placed over the lower chamber 3 is sucked toward the heating plate 26 through the openings O therein and thereby is softened.

As the lower and upper chambers 3 and 14 are partitioned off from each other by the film $f_1$, there is a difference of air pressure between the two chambers 3 and 14. However, with elapse of time, the pressure difference between the two chambers 3 and 14 is decreased progressively and the two chambers 3 and 14 are soon evacuated.

After the elapse of a time period preset by the first timer 80, a switch 82 for the first timer 80 is closed to energize the solenoid 56*a* of the shut-off valve 56 having the throttle valve 57. As a consequence, the valve 56 is changed over to its opened position opposite to that as shown in FIG. 4, while a normally closed relay switch 85 is opened to deenergize the solenoid 59*a* of the valve 59, whereby the valve 59 is changed over to its closed position opposite to that as shown in FIG. 4. As a consequence, atmospheric air flows into only the upper chamber 14 by way of the throttle valve 57, lines 54, 53 and 52, and passages 41 and 22, while the lower chamber 3 remains in its evacuated state due to the check valve 51.

Since the quantity of air introduced into the line 54 is adjusted by the throttle valve 57 at this time, the upper film $f_1$ is lowered relatively slowly with its edge portions sliding between the packing material 27 mounted on the lower surface of the upper head 13 to enclose the lower opening of the upper chamber 14 and the upper surface of the base box 1 at toward 182 A. the peripheral portions of the lower chamber 3, thereby preventing the film $f_1$ from breaking. As soon as the film $f_1$ begins to be lowered slowly, the second timer 81 operates to close a switch 83 for the second timer 83, whereby the solenoid 58*a* of the shut-off valve 58 connected to the main line 53 is energized to change over the valve 58 to its opened position opposite to that as shown in FIG. 4. As a result, a large quantity of air is introduced into the upper side of the film $f_1$, in the lower chamber 3, the film $f_1$ having been lowered toward the table 5, through the valve 58 in addition to the valve 56. Consequently, the film $f_1$ is brought into tight contact with the articles A and the parts of the table paper T around the articles A.

When the air pressure in the chamber 3 is increased to atmospheric pressure, the upper head 13 is automatically moved back to the neutral position by the tensile force of the coil spring 34. At this time, the limit switch 69 mounted on the base box 1 is opened again to deenergize the solenoid 59*a* of the shut-off valve 59, whereby the valve 59 is changed over to its closed position opposite to that as shown in FIG. 4. Thus, the connection between the two chambers 3 and 14 and the vacuum pump 49 is cut. At the same time, the cam 64 fixed to the lower end of the auxiliary link 31 pushes the actuator 65*a* of the switch 65 to change over the valve 62 in the cylinder control pipe line 60 whereby the table 5 is raised to the upper opening of the lower chamber 3. Thus, the operator can take up the articles A which have been packaged between the table paper A and the upper film $f_1$.

While the above described automatic vacuum packaging operation is being carried out, preparatory work is carried out on the left-hand side of the base box 1. More specifically, the preparatory work comprises laying a sheet of the table paper T on the left-hand moving table 6 at its upper position in the left lower chamber 4, placing articles A to be packaged on the table paper T, drawing the upper film $f_2$ forward and over the lower chamber 4 from the roll 72, pushing the button 68 on the front surface of the frame 2 to operate a relay 84, as shown in FIG. 5, connected to a self-holding switch 86, so that a normally closed switch 85 between the limit switch 66 and the solenoid 63*a* is opened to change over the valve 63, whereby the table 6 is lowered.

Then, upon completion of the above described packaging operation on the right-hand side, the upper head 13 is transferred to its left-hand position above the left lower chamber 4 from its neutral position. However, if the preparatory work on one side of the base box 1 has been completed before the vacuum packaging operation is finished on the other side thereof, the upper head 13 can be moved directly from one side to the other without stopping it at the vertical position.

In FIG. 2, when the upper head 13 is moved over the left lower chamber 4, the elongated packing material 47 on the right lower surface of the upper head 13 encloses together the first and second air fluid passages 38 and 39 thereby to establish communication therebetween as described hereinbefore, and the fourth passage 41 registers with the right-hand fluid passage 21 of the upper head 13. Thus, the vacuum packaging operation is performed on the left side of the base box 1 in the same manner as that on the right side thereof.

Thus, the vacuum packaging operation is carried out alternately on the right and left sides of the apparatus. As described hereinabove, in this vacuum packaging apparatus, there is provided a base box 1 having two lower chambers 3 and 4 supporting the upper head 13 forming the upper chamber 14 with a plurality of the links 29, 30 and 31, the upper head being alternately placed on the each of the lower chambers to form alternately vacuum packaging chambers cooperatively with an air fluid control system. Accordingly, the vacuum packaging apparatus according to this invention has an operation corresponding to those of two conventional apparatuses, and the operator can operate the apparatus easily and efficiently without fatigue and without lost time.

What is claimed is:

1. A vacuum packaging apparatus comprising:

a base box having first and second recessed lower chambers with open tops in side-by-side arrangement with a specific space therebetween;

an upper head having a recessed upper chamber with an open bottom adapted to be manually transferable alternately from atop one lower chamber to atop the other thereby to bring the upper chamber into airtight register alternately with the lower chambers to form alternately two vacuum chambers between which upper and lower chambers upper sheets of packaging material are placed, said upper head having, at its open bottom, a heating plate provided with a plurality of openings connecting the upper and lower chambers with each other when the upper head is placed over either of the lower chambers, and functioning to soften each sheet of upper packaging material for packaging the articles, said upper head being supported on the base box by a plurality of pivotable parallel links each having a neutral vertical position between said two lower chambers when said upper chamber is spaced from said lower chambers, at least two of which are respectively connected to two springs held on the base box for urging respective links to rotate in opposite directions to each other, each spring having idling means (36 oside, each link moves, stretching its respective spring;

a vertical movable table disposed in each of the lower chambers and adapted to support thereon packaging material and articles to be packaged;

a vacuum-operated cylinder for vertically moving each of the tables; and a vacuum control system for controlling the air pressures in the vacuum chambers and the vacuum-operated cylinders in accordance with movements of the upper head and the parallel links, said vacuum control system operating the vacuum cylinders in such a manner that the vertical movable table is raised when said links are in said specific range of said neutral position and when the articles are put thereon and is lowered before the upper packaging material is heated by the heating plate after the upper head is placed over either of the lower chambers.

2. A vacuum packaging apparatus according to claim 1 in which said upper head is supported on the base box by a plurality of pivotable parallel links, two of which are provided on the same side with respect to the base box, the two parallel links being connected to respective springs for urging respective links to rotate in opposite directions to each other, the two springs being so connected that the two parallel links can move freely without stretching their respective springs in a specific range on respective sides from their vertical neutral position, and that, after moving beyond the specific range on its respective side, each link moves, stretching its respective spring.

3. A vacuum packaging apparatus according to claim 1, wherein the lower end of each parallel link is connected to one end of each spring, the other end of which is connected to a turning link pivotably provided on the base box to form said idling means, said spring being loosely suspended from the turning link when the parallel links are in their vertical neutral position.

4. A vacuum packaging apparatus comprising:

a base box having first and second recessed lower chambers with open tops in side-by-side arrangement with a specific space therebetween;

an upper head having a recessed upper chamber with an open bottom adapted to be transferable alternately from atop one lower chamber to atop the other thereby to bring the upper chamber into airtight register alternately with the lower chambers to form alternately two vacuum chambers;

a vertical movable table disposed in each of the lower chambers and adapted to support thereon packaging material and articles to be packaged;

a vacuum-operated cylinder for vertically moving each of the tables; and a vacuum contrsage on each side of the upper head for alternately connecting the upper chamber to the vacuum pump, a group of fluid passages in said specific space between the first and second lower chambers extending from the lower to the upper surface of said base box, said group of passages comprising two passages connected to said vacuum pump, a fluid passage formed in the bottom of and connected into each of the lower chambers and said bottom fluid passages being connected to separate passages in the group of fluid passages, passage communicating means on the opposite sides of the lower surface of the upper head to selectively connect one of said separate passages with one of said vacuum pump passages of said group of passages with each other and alternately cooperate with the group of passages, a chamber vacuum control line for connecting the upper and lower vacuum pump passages to the vacuum pump, a cylinder control pipe line for connecting each of the vacuum-operated cylinders for each of the tables to the vacuum pump.

5. A vacuum packaging apparatus according to claim 4 in which said passage communicating means comprises an elongated, closed-figure-shape packing material, formed on each side of the lower surface of the upper head and being capable of surrounding two adjacent passages in the group when the upper head is placed over each of the lower chambers, the position of each of the packing materials being different from each other with respect to the front side of the upper head, either one of said upper fluid passages being in register with one of the fluid passages in the group when the upper head is placed on the base box.

6. A vacuum packaging apparatus according to claim 4 in which said chamber vacuum control line has at least one vacuum-breaking shut-off valve for introducing atmospheric air into each of the vacuum chambers and a direction-control valve for introducing a vacuum into the each of the vacuum chambers, said each of the cylinder control pipe lines having a direction-control valve for operating a respective one of the vacuum-operated cylinders, said the direction-control valve in the chamber vacuum control line being operated by a switch located on the surface of the base box and operated by the lower surface of the upper head, said direction-control valve in each of the cylinder control lines being operated by one of two switches operated by a cam fixed at the lower end of one of said links.

* * * * *